US006239336B1

(12) United States Patent
Orii et al.

(10) Patent No.: US 6,239,336 B1
(45) Date of Patent: May 29, 2001

(54) MUSIC BOX HAVING AN IMPROVED, RIGID BASE FRAME

(75) Inventors: Makoto Orii; Katsuhiko Hayashi, both of Nagano (JP)

(73) Assignee: Sankyo Seiki Mfg. Co., Ltd., Nagano-ken (JP)

( * ) Notice: Subject to any disclaimer, the term of this patent is extended or adjusted under 35 U.S.C. 154(b) by 0 days.

(21) Appl. No.: 09/162,711

(22) Filed: Sep. 29, 1998

(30) Foreign Application Priority Data

Oct. 2, 1997 (JP) ..... 9-286029
May 8, 1998 (JP) ..... 10-142222

(51) Int. Cl.[7] ..... G10F 1/06
(52) U.S. Cl. ..... 84/95.1
(58) Field of Search ..... 84/94.1, 94.2, 84/95.1, 95.2, 96–101

(56) References Cited

U.S. PATENT DOCUMENTS 3,747,459 7/1973 Schmidt et al. .
4,197,778 * 4/1980 Komatsu ..... 84/95.1
4,557,173 12/1985 Isaka .

FOREIGN PATENT DOCUMENTS 0762240 11/1997 (EP) .
7302079 11/1995 (JP) .
WO9618993 6/1996 (WO) .

* cited by examiner

*Primary Examiner*—Stanley J. Witkowski
(74) *Attorney, Agent, or Firm*—Reed Smith LLP

(57) ABSTRACT

A music box with reduced weight and improved sound quality has a base frame that is formed by plastic deformation of a plate that includes a metal material, a drum that is held on the base frame and which comprises a plurality of engaging pins, a comb that is fixed to a comb mount formed on the base frame and which generates a given sound by being picked by the engaging pins, and an improved, rigid base frame.

23 Claims, 8 Drawing Sheets

MUSIC BOX HAVING AN IMPROVED, RIGID BASE FRAME

BACKGROUND OF THE INVENTION

The present invention relates to a music box which plays pieces of music by picking reeds with a plurality of pins formed on a don In a conventional music box, a wind shaft and a base frame, to which a supporting portion of a driving gear and a comb are mounted, are mainly formed by molding iron and zinc via die casting. Also, Japanese Utility Model Publication No. S62-24310 and Japanese Laid-Out Patent No. H7-303079 provide a music box in which a base portion and a pair of parallel support arm portions, perpendicular to the base portion, are formed together as a base frame by means of bending a comparatively thick iron plate by pressing such that the support arm portions support a drum and a comb is fixed to the base portion. In this case, the comb comprises a plurality of combs or reeds assigned for given musical tones.

However, a base frame made of iron or zinc die cast requires a weight and volume more than given values in order to transmit vibration of the comb; also, a relatively long period of time is required for casting. Therefore, the cost for materials and manufacturing tend to be high. Furthermore, the weight of the base frame prevents improvement in productivity and causes an increased transportation cost. Also, the cost for row materials tends to be affected by the international market such that reduction in the cost of materials, such as zinc, would be limited. Therefore, it is difficult to reduce the cost for manufacturing and materials.

On the other hand, it is possible to reduce the weight and the manufacturing cost of the base frame which is formed by bending a plate. However, the rigidity and the weight of the base frame are not sufficient such that the quality of sound of the music box is deteriorated. If the thickness of the plate is increased in order to obtain the rigidity and the weight, on the other hand, it is difficult to press-process it. As a result, a larger presser is required and the life of a metal mold is shortened such that the cost for the processing equipment gradually increases.

OBJECTS AND SUMMARY OF THE INVENTION

Therefore, it is an object of the present invention to improve the cost performance by manufacturing a base frame of a music box by means of plastic deformation of a steel plate for improving productivity and reduction in the material cost.

It is a further object of the present invention to reduce the weight of the music box and to improve the quality of sound Plastic deformation is defined herein as processes including bending, drawing and die-cutting by pressing and component rolling.

To carry out the above-stated objects, in accordance with the present invention, a music box is comprised of a base frame formed by plastic deformation of a plate including a metal material, a drum held on the base frame and which comprises a plurality of engaging pins, a comb fixed to a comb mount formed on the base frame and which generates a given sound by being picked by the engaging pins, and a rigid base frame using a plurality of ribs to increase the rigidity thereof.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which:

FIGS. 14(A) and 14(B) show a base plate fixing means in a tenth embodiment of the present invention wherein FIG. 14(A) is a disassembled oblique view showing assembly of the base plate, and FIG. 14(B) is a plan view and a partial side view of a fixing means on the base frame.

DETAILED DESCRIPTION OF CERTAIN PREFERRED EMBODIMENTS

Figure 1A:
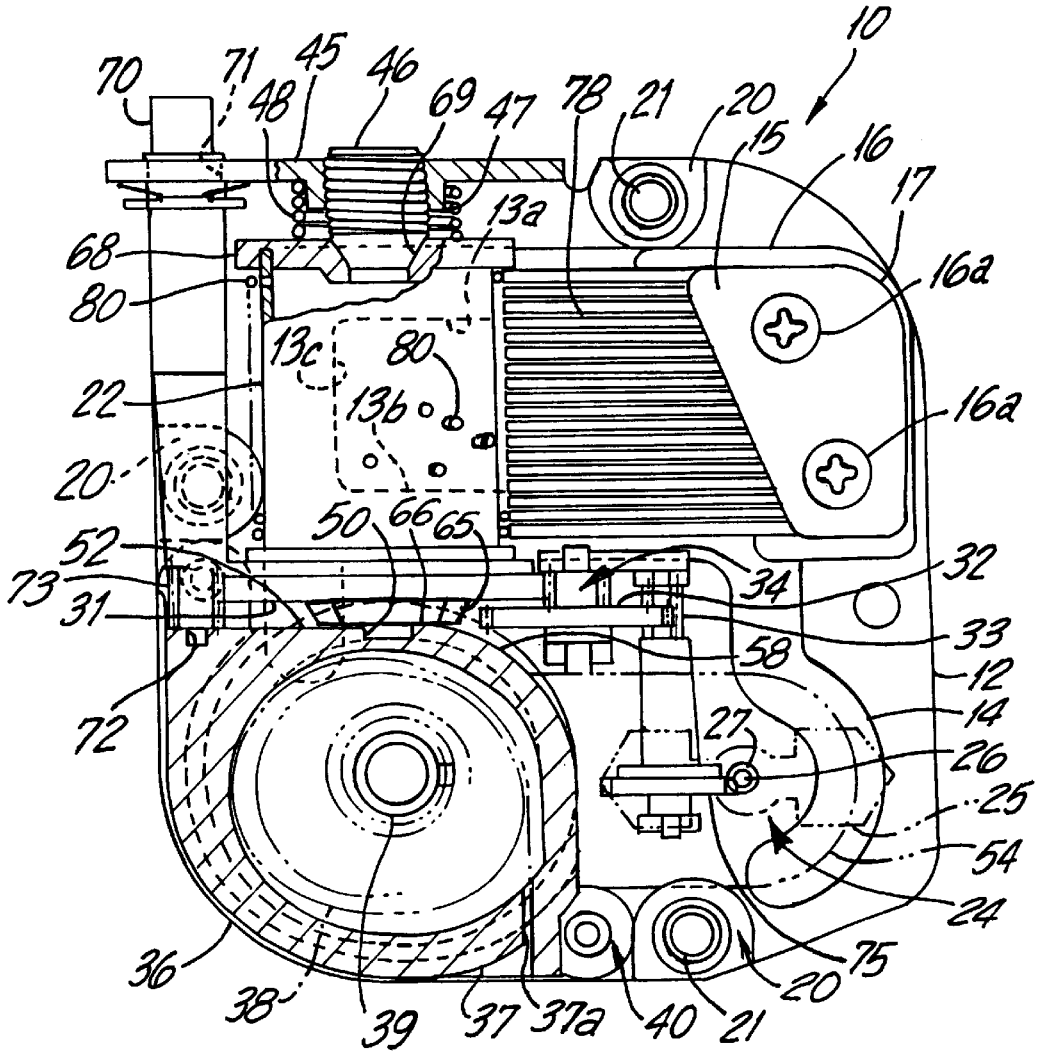
FIGS. 1(A) and 1(B) are an entire plan view and a partial side view of a housing of a first embodiment of the present invention.
Figure 1B:
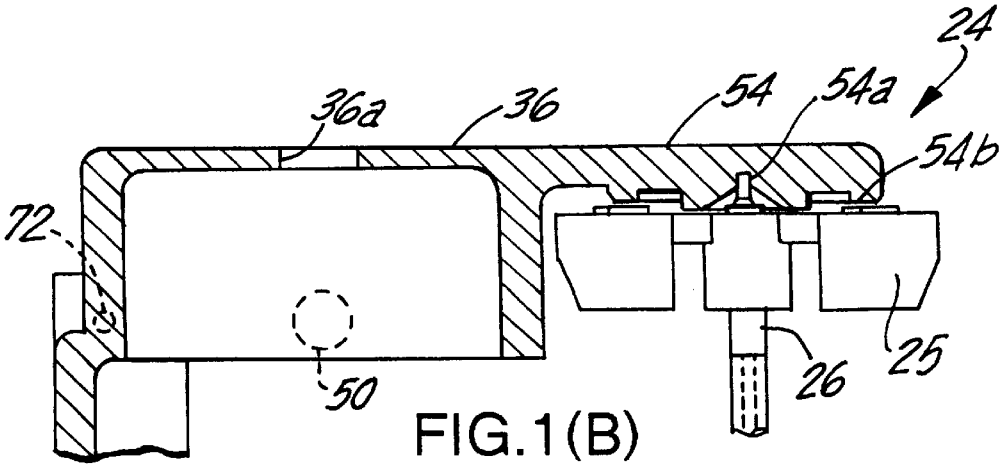

The following is a description of a music box in accordance with a first embodiment of the present invention. FIGS. 1(A) and (B) are an entire plan view and a partial side view of music box 10 of the present invention. In FIG. 1(A), housing 36 holds spring 38, which stores the driving force as a drive of the music box. The outer end of spring 38 is fixed at groove 37*a* formed on side wall 37 of housing 36 while the inner end of spring 38 is fixed on wind shaft 39 which is supported by shaft hole 36*a*. Also, as shown in FIG. 1(B), housing 36 comprises bracket 54 which projects from the upper surface of the housing. Bracket 54 provides pivot bearing 54*a*, which supports the upper end of worm rotational shaft 26 of speed adjusting rotational body 25, and movement controlling surface 54*b* which controls rotation of speed adjusting rotational body 25. In Embodiment 1, housing 36 is a finished product made of a synthetic resin and the like and is fixed to base frame 12 by a hinge and caulking using a hole and a boss formed on mount 40.

Wind shaft 39 forms a one-directional clutch via bevel gear 58 of the first gear and an ordinary ratchet means (not shown in the figure). Wind shaft 39 also comprises a projection portion which projects from bottom surface 19 of base frame 12 downward and to which an appropriate handle or a knob (not shown in the figure) is connected in order to wind spring 38. Small bevel gear 65 of the second gear engaging to bevel gear 58 comprises rotational shaft 66 which is perpendicular to wind shad 39; together with spur gear 31, small bevel gear 65 fixes one end of drum 22. Rotational shaft 66 is supported by bearing hole 50 formed on flat side wall 52 of housing 36.

On the other hand, flange 68, which fixes the other end of drum 22, has center hole 69 with a tapered inner wall such that drum 22 is rotatably supported by engaging to the tapered surface at the end of pivot bearing 46 which is screwed to boss portion 47 projected into bearing frame 45. Also, an external thread is formed on the outside of pivot bearing 46. Thus, by screwing or unscrewing it, the contact with the tapered surface can be adjusted such that friction resistance of drum 22 can be adjusted.

Furthermore, compressed coil spring 48 as a pressurizing means is formed between flange 68 and bearing frame 45 such that a force is applied to drum 22 in the thrust direction. As a result, a loss in transmission of vibration due to a shake of drum 22 can be reduced, and correct positioning of drum 22 in relation to comb 15 and smooth rotation can be accomplished. However, it is possible to hold and to position the drum in place only with the screwing force of pivot bearing 46. Also, the outside of pivot bearing 46 may be formed of, instead of the external thread, some concavity and convexity for preventing extrusion such that pivot bearing 46 is fixed by caulking from the outside of boss portion 47 for holding drum 22. As described above, drum 22 is placed between housing 36 and bearing frame 45.

Composite spur gear 31 is formed on one end of drum 22 and is connected to acceleration gear train 34. Rotation of composite spur gear 31 is transmitted via composite spur gear 32 to worm gear 75, which is formed together with composite spur gear 33 to rotate speed adjusting rotational body at a high speed. The speed adjusting mechanism of the music box is formed of movement controlling surface 54*b*, formed on bracket 54, speed adjusting rotational body 25 and acceleration gear train 34.

Comb 15 has reeds 78 to form a shape resembling a comb; it is firmly fixed to comb mount 16, formed on base frame 12 by drawing, by means of screwing tapping screw 16*a* into lower hole 16*b*, formed by drilling on comb mount 16. The ends of reeds 78 in a straight line project in the path in which engaging pins 80, formed on drum 22, rotate. Accordingly, the ends of reeds 78 are maintained at a given engaging position in relation to engaging pins 80. Engaging pins 80 are formed on drum 22 in an order particular to a piece of music played. On the other hand, reeds 78 are timed to a particular musical scale for the piece of music. In the case of additional processing to form an internal thread in lower hole 16*b*, tapping screw 16*a* can be an ordinary screw.

Output shaft 70, parallel to drum 22, is supported by bearing hole 72 on housing side wall 52 and bearing hole 71 of bearing frame 45 such that pinion 73, formed together with output shaft 70, is geared to composite spur gear 31. As a result, a force is provided to a mechanically connected toy or dot.

The following describes functions of music box 10 of the present invention with the structure described above. A handle or a knob connected to wind shaft 39 is used to manually wind spring 38 such that a spring force is stored. Because of the ratchet means (not shown in the figure), rotation of wind shaft 39 by winding of itself is not transmitted to bevel gear 58 of the first gear. When the winding is suspended to free wind shaft 39, the stored force of spring 38 is released such that wind shaft 39 rotates bevel gear 58 via the ratchet means.

Small bevel gear 65 engaged to bevel gear 58 is rotated by gearing to bevel gear 58, as well as gearing to composite spur gear 31, formed together with small bevel gear 65, and drum 22. The ends of reeds 78 of comb 15 are picked by corresponding engaging pins 80 of drum 22 such that a given piece of music is played. At the same time, output shaft 70 rotates to provide the rotational force to a connected mechanism such as a dog (not shown in the figure). On the other hand, speed adjusting rotational body 25 rotates at a high speed while being controlled by the rotational force transmitted to acceleration gear train 34 such that the stored force of spring 38 is prevented from being released all at once by the rotational resistance. As a result, rotation of drum 22 is maintained smooth such that the play is maintained at a sufficient tempo.

Figure 2:
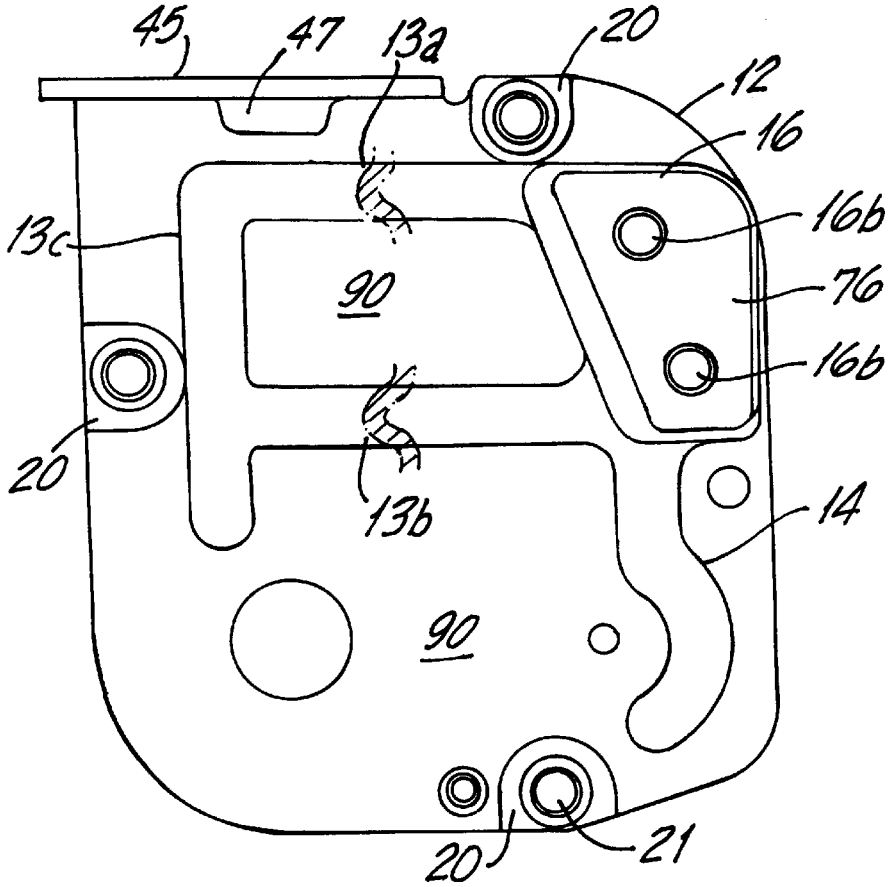
FIG. 2 is a plan view of a base frame of the first embodiment.
Figure 3:
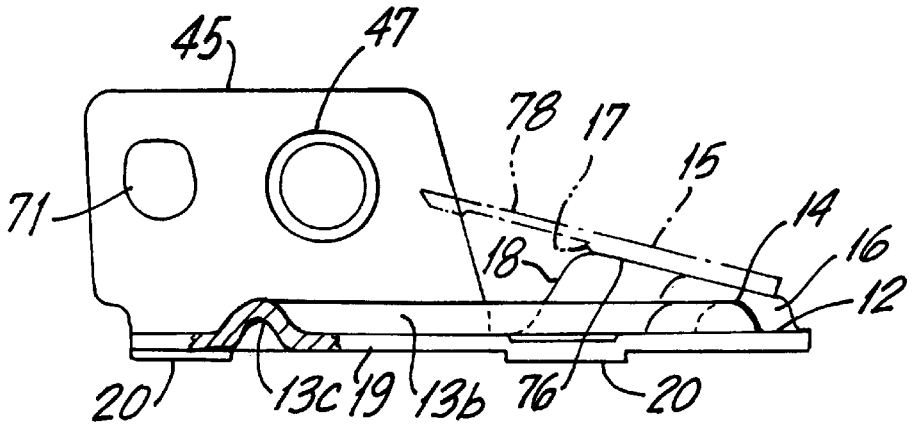
FIG. 3 is a side view of FIG. 2 showing a part as a cross section.

The following describes an embodiment of a base frame in a music box of the present invention in reference to drawings. First, base frame 12 of Embodiment 1 is shown in FIGS. 2 and 3. FIG. 2 is a plan view of base frame 12. FIG. 3 is a side view of base frame 12 showing a part as a cross section Base frame 12 is formed by plastic deformation of a thickness 1.2 mm steel plate. The thickness of the plate is not limited to the above value as long as it is within a range allowing plastic deformation; however, 3 mm or less is more appropriate. More specifically, 1.2 mm is the most appropriate considering efficiencies in rigidity and transmission of vibration and readiness in processing. In base frame 12 of the present invention, the rigidity is obtained by forming nbs (or beads), discussed in a later section, by plastic deformation (beading) on flat portion 90 of base frame 12.

Furthermore, although base frame 12 is a thickness 1.2 mm steel plate, work hardening can be caused by graining the surface such that the rigidity strength and flatness can be improved. Graining is herein defined as a process to evenly form small grain-like press patterns on an entire surface of a metal plate and the like by a pressing process, such as coining. Also, such a base frame can be formed by using a metal plate other than steel plate, a synthetic resin or an FRP.

Comb 15 is fixed to comb mount 16, formed on base frame 12 by drawing, with screw 16*a*. Comb mount 16 is formed such that it can be fixed tightly with its surface facing base portion 17 of comb 15 contacting the entire surface of base portion 17 of comb 15; therefore, high efficiency in transmission of vibration can be obtained. Especially, efficiency in transmission of vibration can be effectively improved by firmly contacting the bottom part of reeds 78 of base portion 17 to comb mount 16.

Comb mount 16 is slanted in relation to flat portion 90 such that when comb 15 is fixed thereon, the ends of reeds 78 project almost directly toward the center of rotation of drum 22. By slanting the comb mount, the drawing depth is reduced such that unusual deformation can be avoided. Additionally, the thickness is maintained such that strength can be maintained within the limitation of the tensile strength of the materials. Furthermore, comb mount 16 is formed such that its drawn portion on the edge is formed as slope 18 and that the border between the upper surface of comb mount 16 and slope 18 is formed to be round (to maintain R). As a result, the rigidity is maintained while processing is made easy.

The edge of comb mount 16 and flat portion 90 are a continual body without any open end. Therefore, when a music box is mounted while base frame 12 tightly contacts a resonance board (not shown in the figure), a hollow space is formed by the bottom part of comb mount 16 such that the space functions as a resonance space to prevent a loss of sound energy.

Comb mount surface 76 of comb mount 16 is formed wider than the surface of comb base portion 17. As a result, by fly fixing the entire surface of comb base portion 17 to comb mount surface 76, a loss in tranmission of vibration is reduced such that the sound quality is improved.

In addition, bases 20, used for mounting a music box onto a mount product as a resonance board, are formed on bottom surface 19 of base frame 12. Bases 20 are positioned at three separate points which are not on a line, that is, three points equivalent to vertexes of a triangle; they are also formed of a convex surface with a relatively small area. Therefore, base frame 12 can be firmly mounted on a plane formed by three points, which are not on a line, to prevent shaking, although the mount product does not have an even surface. Furthermore, approximately at the center of each base 20, screw hole 21 is formed to screw down a music box to the mount product. Therefore, when a music box is mounted to the mount product by inserting a screw into screw hole 21, base 20 functions even more effectively such that the sound energy can be efficiently transmitted to the resonance board for amplification while maintaining the sound quality.

Ribs 13*a*, 13*b*, 13*c* and 14, which are formed by plastic deformation of a steel plate for increasing the rigidity of base frame 12, project as a continual ridge-like convexity with an arc-shaped cross section. A first nib group includes two branches of ribs 13*a*, 13*b*, extending from comb mount 16 to the bottom of the position where drum 22 is mounted, and rib 13*c* which connects the two branches of ribs. The first rib group forms a square separation together with comb mount 16 underneath comb 15 and drum 22. When a stress is applied to base frame 12 from the outside, the first rib group prevents base frame 12 from warping such that the relative positions of comb 15 and drum 22 are not easily altered. In other words, the lined ends of reeds 78 formed on comb 15 are maintained at a given engaging position in relation to engaging pins 80 formed on the outside of drum 22 such that a distance for appropriate engaging can be maintained. Also, the rigidity between housing 36 and bearing frame 45 is strengthened to ensure from support for drum 22 and smooth rotation of drum 22.

A second rib group is rib 14 which extends from comb mount 16 and surrounds the outer edge of a bearing of worm 27, as rotational shaft 26 of speed adjusting rotational body 25, in an arc shape; it strengthens the rigidity of base frame 12 in the vicinity of the speed adjusting device. The second rib group prevents deformation of base frame 12 from interfering with speed adjusting effects of speed adjusting body 25 in speed adjusting mechanism 24, which rotates at a high speed; also, rotation of speed adjusting body 25 is stabilized such that more accurate speed adjusting effects can be obtained.

Moreover, rib 13*c* extends further to the vicinity of housing 36 after perpendicularly crossing two branches of ribs 13*a*, 13*b*; therefore, it, together with rib 14, increases the rigidity of base frame in the vicinity of housing 36. Rib 13*c* and nb 14 form a third rib group.

According to the above structure, when music box 10 is mounted on a resonance board (not shown in the figure), ribs 13*a*, 13*b*, 13*c* and 14 and comb mount 16 form a resonance space such that a sound effect of the music box is increased.

Also, the cross section of nbs 13*a*, 13*b*, 13*c* and 14 is shaped as an arc in Embodiment 1; however, one is not limited to the above as long as the shape increases the rigidity of base frame 12.

Bearing frame 45 of drum 22 is formed together with a part extending from base frame 12 by perpendicularly bending the part. Drum 22 is rotatably supported by pivot bearing 46 fixed to boss 47 which is projected from bearing frame 45 by drawing. At the same time, bearing hole 71 is formed on bearing frame 45 such that it is unnecessary to form an attachment base plate when output shaft 70 is assembled.

Figure 4:
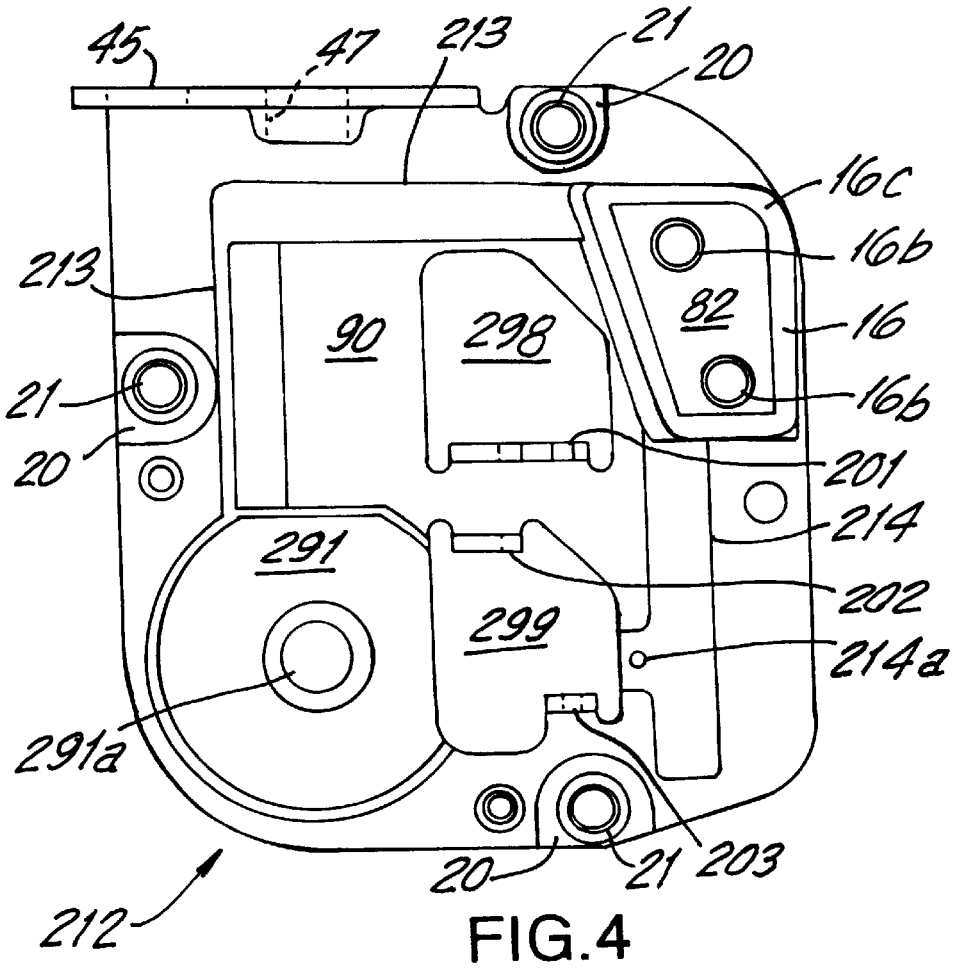
FIG. 4 is a plan view of a base frame of a second embodiment of the present invention.
Figure 5:
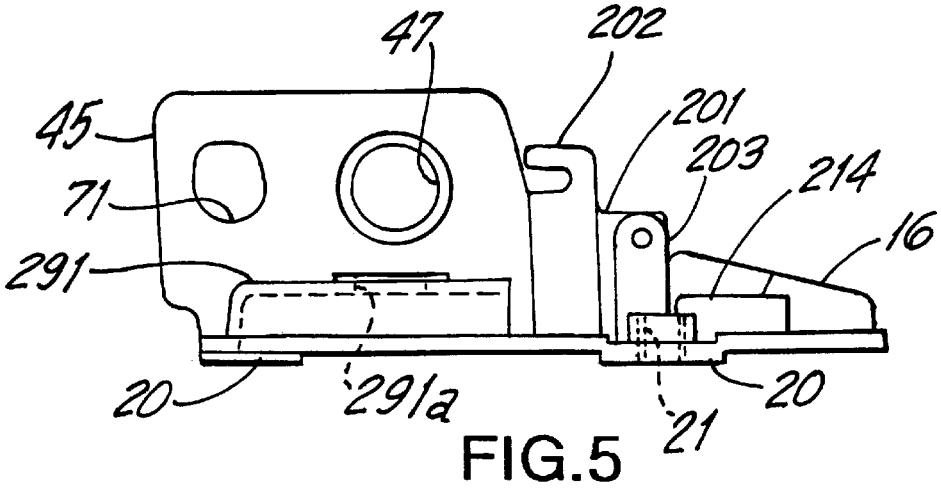
FIG. 5 is a side view of FIG. 4.

Referring to FIGS. 4 and 5, the following is a description of the music box in accordance with the second embodiment of the present invention FIG. 4 is a plan view of base frame 212 of Embodiment 2. FIG. 5 is its side view. Any structure similar to the ones in Embodiment 1 are indicated with identical symbols to omit any descriptions thereof. Differences of Embodiment 2 from Embodiment 1 are that in addition to rib patterns and comb mount 16, bearing portions such as acceleration gear train 34 and speed adjusting rotational body 25 of a speed adjusting device are formed on flat portion 90 of base frame 212. In other words, when base frame 212 is plastically deformed by pressing, a plurality of bearing portions are formed thereon at the same time. Also, the shape of nbs is altered to correspond to formation of the bearing portions.

First bearing portion 201 supports composite spur gear 32 between itself and second bearing portion 202; at the same time, it supports worm gear 75, which is formed together with composite gear 33, between itself and third bearing portion 203. First gearing portion 201 is formed by cutting a part of flat portion 90 which was a part of space portion 298 at a part of flat portion 90. Also, the second and third bearing portions are formed by cutting a part of flat portion 90 from another space portion 299.

Mount 291 supporting housing 36 is, similar to comb mount 16, formed on flat portion 90 of base frame 212 by deep drawing. Also, mount 291 is a plane parallel to flat portion 90 used as a support for bevel gear 58. Additionally, 291*a* is formed as a bearing hole for wind shaft 39.

Furthermore, first nib 213 and second rib 214 are formed on flat portion 90. First rib 213 extends from comb mount 16 to the bottom of the drum and perpendicularly bend toward base 291 such that it forms a pattern in which comb mount 16 and base 291 are connected. Also, second rib 214 extends from comb mount 16 to the bottom of the speed adjusting device. Similar to the ribs in Embodiment 1, these ribs increase the rigidity of base frame 212 while improving the sound quality of the music box Moreover, bearing 214*a* is formed in second rib 214 at a position across from pivot bearing 54*a* formed on bracket 54 of housing 36. Both support the ends of worm rotational shaft 26 of speed adjusting rotational body 25.

Additionally, in this embodiment, the rigidity of comb mount 16 is increased by surrounding the upper edge of comb mount 16 within nb 16*c* such that the sound quality is improved. As a result, the vibration of comb 15 is efficiently transmitted to a resonance board (not shown in the figure) onto which the music box is mounted. Rib 16*c* is not necessarily formed to cover the entire upper edge of comb mount 16; it is possible to form it on a part of the edge almost parallel to drum 22 such that the bottom part of reeds 78 of comb base portion 17 firmly contacts comb mount 16.

According to Embodiment 2 as described above, an output shaft is supported by housing 36 and bearing frame 45 formed on base frame 212. Also, when base frame 212 is plastically deformed, the bearing portions for shafts of acceleration gear train 34 and the speed adjusting mechanism are formed together wit base frame 212 by cutting out;

therefore, it is not necessary to separately form bearing members and the like. As a result, a number of parts and assembly steps can be reduced such that productivity is increased.

Figure 6A:
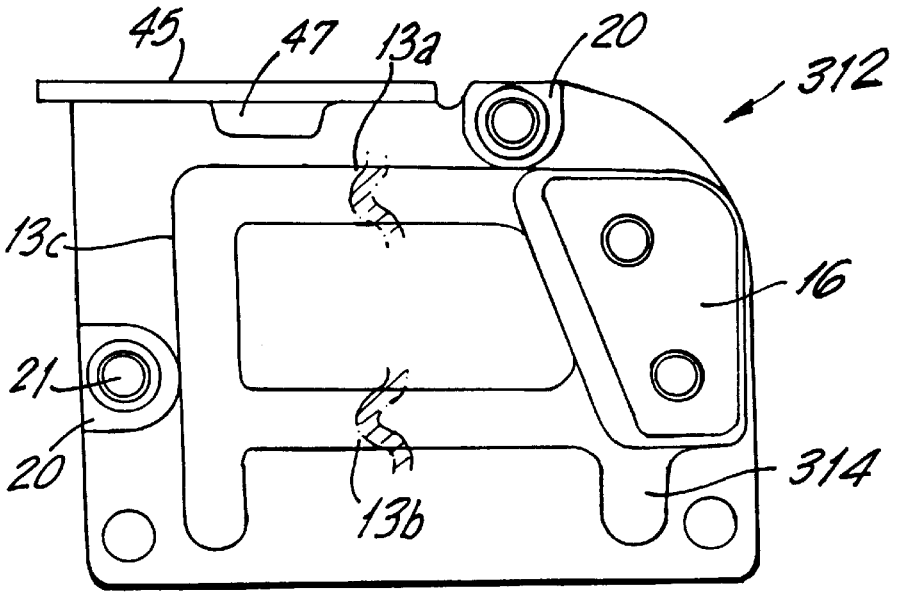
FIGS. 6(A) and 6(B) are a plan view and a side view of a base frame of a third embodiment of the present invention.
Figure 6B:
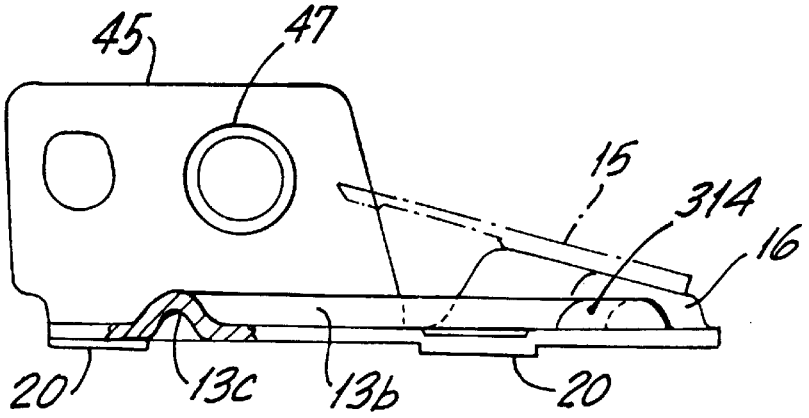
Figure 7:
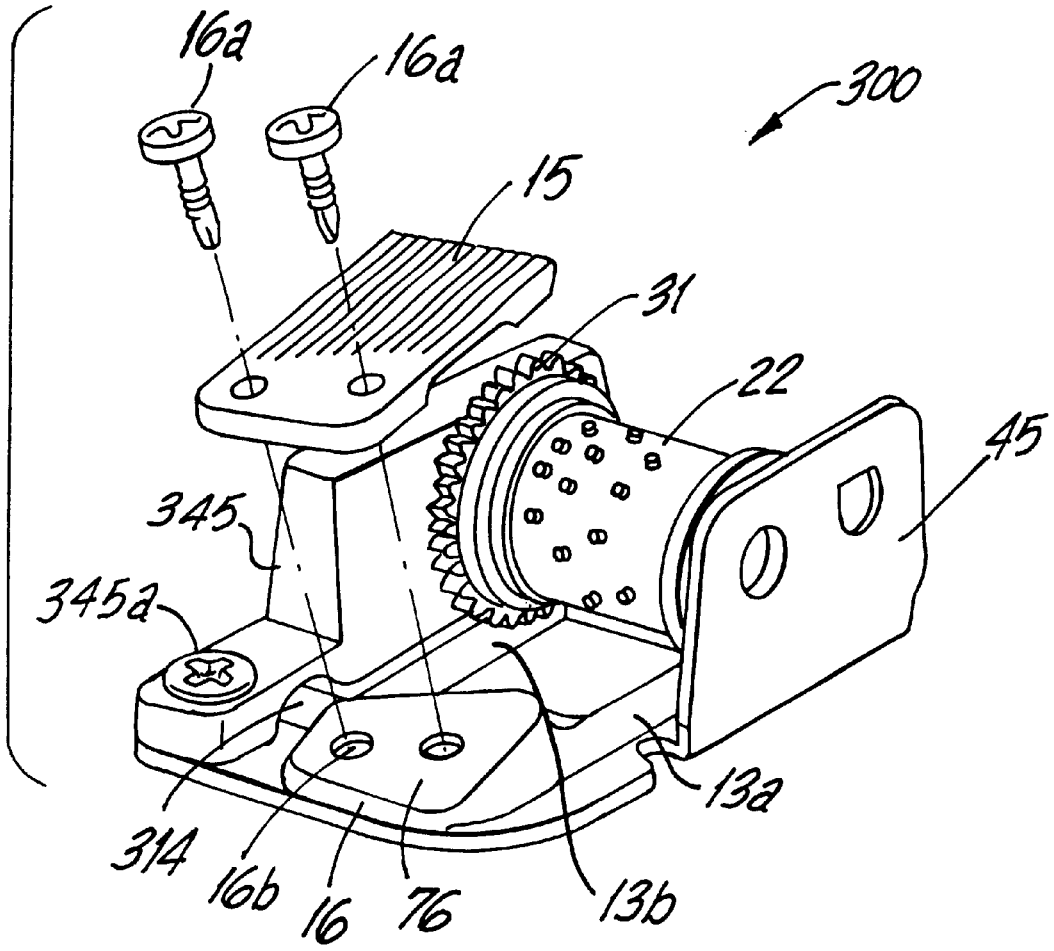
FIG. 7 is a disassembled oblique view showing a structure of an embodiment of the present invention.

Embodiment 3 is shown in FIGS. 6(A) and (B) and 7. FIG. 6(A) is a plan view of base frame 312 of Embodiment 3. FIG. 6(B) is its side view. FIG. 7 is an oblique view showing an assembly structure of music box 300 of Embodiment 3. Music box 300 of Embodiment 3 does not comprise a drive such as a spring device; it only has a playing section in which comb 15 and drum 22 are supported by base frame 312.

Ribs 13*a*, 13*c* and 314, similar to the ones in Embodiment 1, are formed on base frame 312. Rib 314 is formed short starting from comb mount 16 and is parallel to the direction of the rotational shaft of drum 22. This structure increases the rigidty of base frame 312. At the same time, similar to Embodiment 1, when music box 300 is mounted to a resonance board (not shown in the figure), comb mount 16 and first and second nbs 13*a*, 13*b*, 13*c*, 314 form a sealed space as a resonance space such that the sound effect of the music box is improved.

Also, as shown in FIG. 7, on the opposite side of drum 22 from beating frame 45, bearing body 345 is mounted. Bearing body 345 comprises bearing hole 50, rotational shaft 66 which is formed together with spur gear 31 of drum 22, and bearing hole 72, which supports bearing pinion 73 of output shaft 70; it also supports drum 22 and output 70 along with bearing frame 45. Also, in Embodiment 3, bearing body 345 is a synthetic resin product separate from base frame 312; it can be formed of a metal plate or by bending base frame 312 similar to bearing frame 45.

Figure 8:
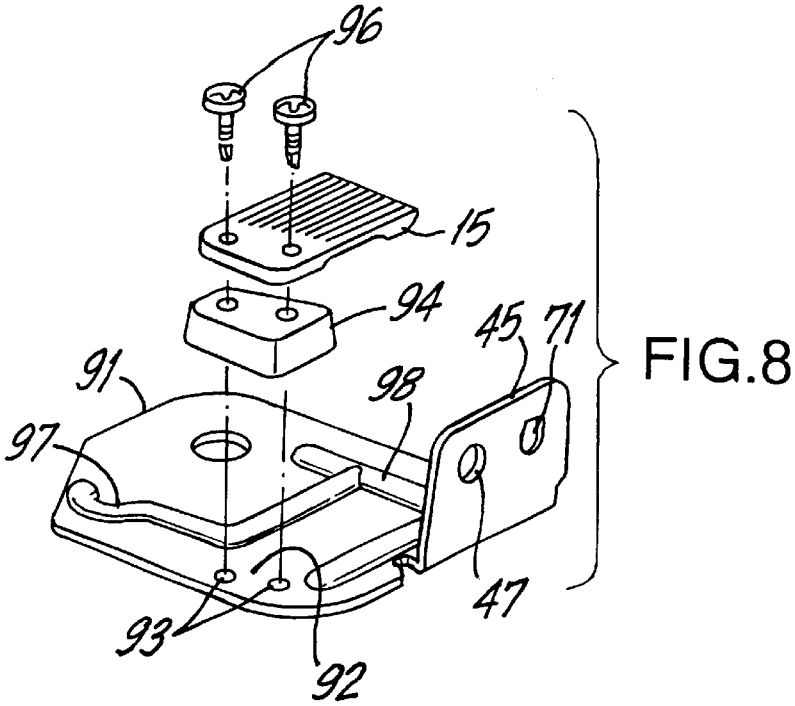
FIG. 8 is a disassembled oblique view of a comb mount of a fourth embodiment of the present invention.

Music box 300 structured as described above is driven by an outside drive such as an electric motor and manual crank handle having a rotation transmitting gear train, which engages to spur gear 31, for playing a piece of music. Also, the drive can be positioned in various structures such that a product having music box 300 can be freely designed FIG. 8 is a disassembled oblique view of a comb mount in Embodiment 4 of a music box of the present invention. Lower holes 93 are formed on comb mount portion 92 of base frame 91 by drilling. Comb mount 94 is formed with a steel plate separate from base frame 91 into a shape similar to comb mount 16 of Embodiment 1. Then, it is firmly fixed by tapping screws 96 together with comb 15. Comb mount 94 can be formed of a synthetic resin and assembled to base frame 91, or formed by molding.

When comb mount 94 is formed of a separate member as described above, press formation of base frame 91 becomes easier. Also, a material of comb mount 94 can be appropriately chosen such that tone quality can be altered according to differences in forms of transmission of vibration. Also, ribs 97, 98 have the same shape and pattern as ribs 13, 14 of Embodiment 1 such that it is formed projecting from base frame 91. Other structures are identical to Embodiment 1 such that any common parts are indicated with identical symbols to omit any descriptions.

Figure 9:
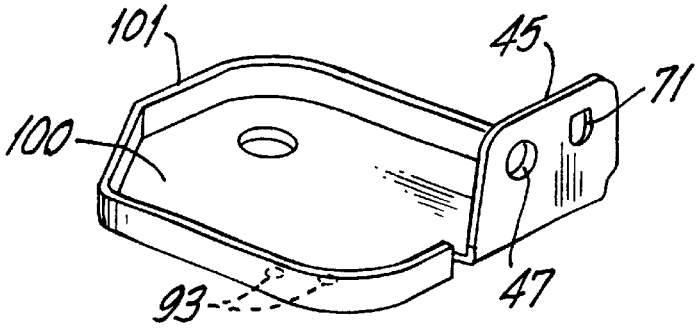
FIG. 9 is an oblique view of a base frame of a fish embodiment of the present invention.

FIG. 9 is an oblique view of base frame 100 in Embodiment 5 of a music box of the present invention. Rib 101 is formed by drawing the bent outer edge of base frame 100 such that a press form used for the pressing process can be simplified. Other structure is identical to Embodiment 1 such that any common parts are indicated with identical symbols to omit any descriptions.

Figure 10:
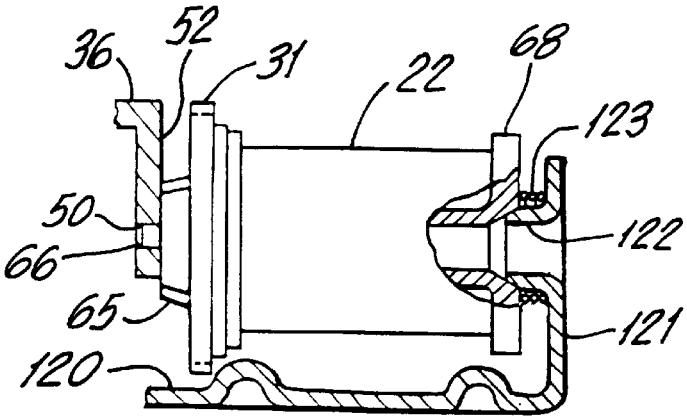
FIG. 10 is a side view with a partial cross section showing a relationship between a drum and a bearing frame of a sixth embodiment of the present invention.
Figure 11:
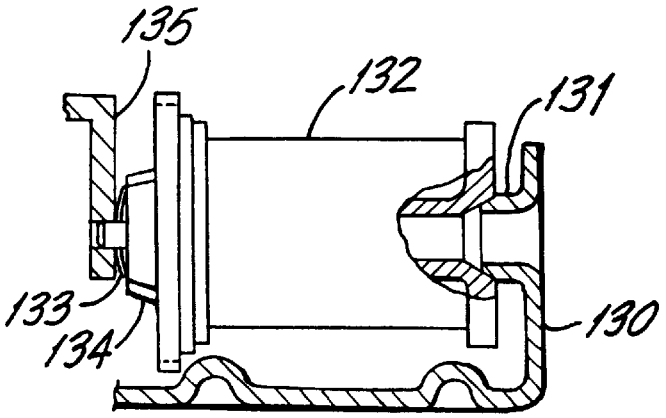
FIG. 11 is a side view with a partial cross section showing a relationship between a drum and a bearing frame in a seventh embodiment of the present invention.
Figure 12:
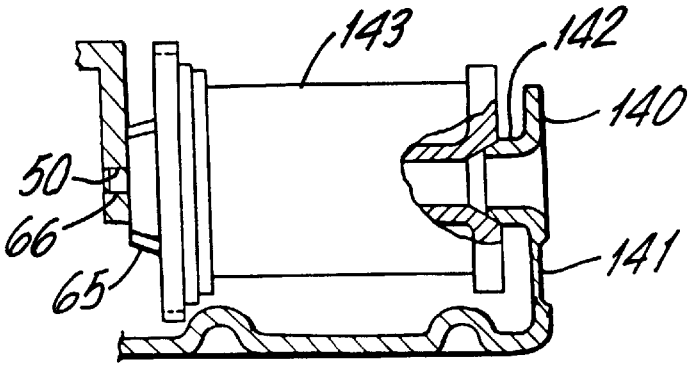
FIG. 12 is a side view with a partial cross section showing a relationship between a drum and a bearing frame in an eighth embodiment of the present invention.

FIGS. 10 through 12 are embodiments 6 through 9 showing a relationship between a drum and a bearing frame formed on a base frame in a music box of the present invention. FIG. 10 is Embodiment 6. Drum 22 structured in a similar manner as in Embodiment 1 is supported by support shaft 122 which is projected from bearing frame 121 of base frame 120 by drawing. Since drum 22 receives a force in the thrust direction from compressed coil spring 123 as a pressuring means, pivot bearing 46 in Embodiment 1 is not required herein. Instead of compressed coil spring 123, a flat spring can be used. Other members are indicated by symbols common to ones in Embodiment 1.

FIG. 11 is Embodiment 7 having the same structure as Embodiment 6 in which drum 132 is supported by support shaft 131 projected from bearing frame 130. However, it is unique that flat spring 133, which is a elastic body as a pressurizing means to provide a force to drum 132 in the thrust direction, is mounted between the side of small bevel gear 134, formed uniform with drum 132, and housing side wall 135. Flat spring 133 is formed as a U shape such that it can be inserted from the side after assembling drum 132; as a result, assembling work is simplified.

FIG. 12 is Embodiment 8. Elastic function 141 as a pressurizing means is given to bearing frame 140 such that drum 143 is supported by support shaft 142 in a similar way to Embodiment 6. Elastic function 14 is the lower side of support shaft 142 of bearing frame 140 and is formed by pressing such that the side opposite from drum 143 becomes thinner, resulting in readiness in elastic deformation. In this case, bearing frame 140 has elastic function 141 such that it is not necessary to separately form a elastic member.

Figure 13:
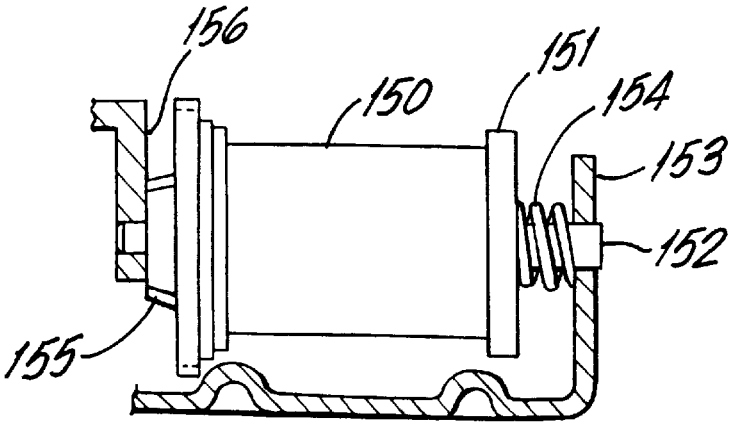
FIG. 13 is a side view with a partial cross section showing a relationship between a drum and a bearing frame in a ninth embodiment of the present invention.

FIG. 13 is Embodiment 9. Rotational shaft 152, projected from the center of flange 151 of drum 150, is rotatably supported by bearing frame 153 such that compressed coil spring 154 provides a force in the thrust direction. Not shown in the figure, it can be that, as in Embodiment 8, a thinning portion, which is formed on rotational shaft 152 projected from flange 151 of drum 150, is rotatably supported by bearing frame 153 such that flat spring 133 is mounted between small bevel gear 155 and housing side wall 156 to provide a force to drum 150 in the thrust direction. As a result, the force can be supported by the thinning portion of rotational shaft 162.

Embodiments 6 through 9 shown in FIGS. 10 through 13 ensure that the positional relationship in the rotational direction between engaging pins 80 formed on drum 22, 132, 143, 150 and the ends of reeds 78 can be accurately maintained by a force in the thrust direction loaded by various elastic bodies 123, 133, 141, 154, similar to a pressurizing means of compressed coil spring 48 in Embodiment 1, such that the drum is smoothly rotated. Other structures in Embodiments 6 through 9 shown in FIGS. 10 through 13 can be combined with the ones of Embodiments 1 through 5.

Also, the structures shown in FIGS. 11, 12 and 13 have a pressurizing means which pressurizes the drum in the thrust direction. Therefore, by mounting the drum to a bearing frame, then a driving unit having a spring, the drum can be pressurized without special adjustment of the pressure.

Figure 14A:
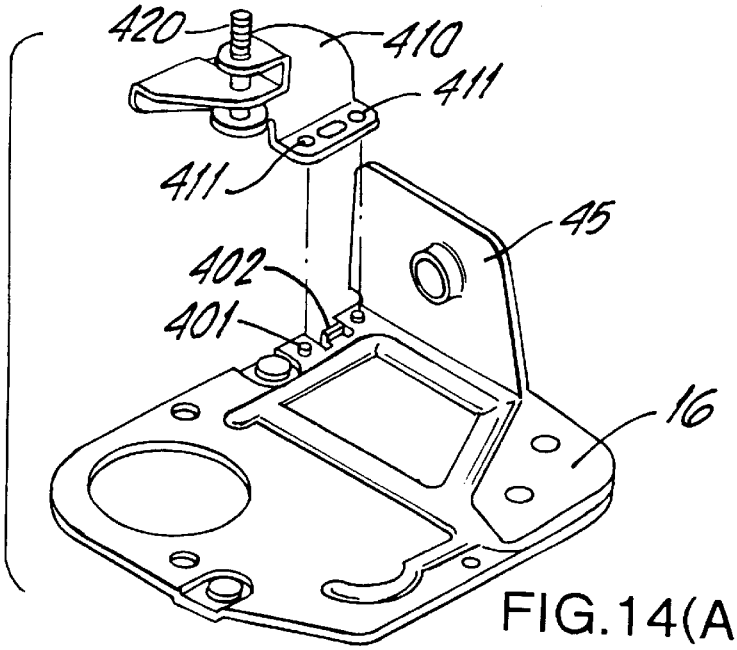
Figure 14C:
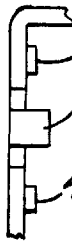
Figure 14B:
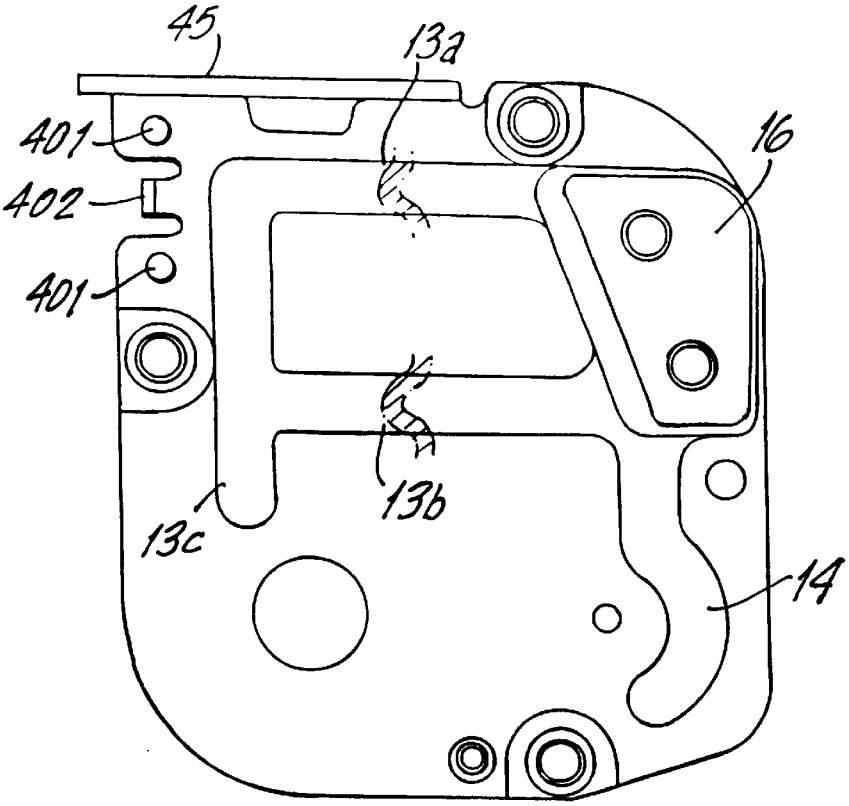

In the embodiments described above, bearing means, to which output shaft 70 is assembled, are formed on base frame 45 and housing 36 in advance such that mechanically connected dolls and toys can be driven by mounting output shaft 70 if necessary. However, a design of the mechanically connected parts is prevented from being freely designed by a uniform structure required for mounting output shaft 70. Therefore, in Embodiment 10 shown in FIG. 14, a base plate fixing means is formed at the end of base frame 12 opposite from comb mount 16 on the other side of drum 22 to fix an attachment base plate. As a result, base plate 410, onto which various attachments are mounted, is easily fixed to base frame 12. Base plate 410 shown in FIG. 14(A) obtains outputs of directions and rotational speeds different from output shaft 70 by having attachment 420 which extends from spur gear 31 and rotates around a shaft perpendicular to the rotational shaft of drum 22. Also, the attachment can be further freely designed by changing the shape of the base plate.

The base plate fixing means includes a fixing means on base frame, which has a pair of positioning bosses 401, 401 and caulking projection 402, and a fixing means on base plate 410, onto which attachments are mounted. The fixing means on base plate 410 has positioning holes 411, corresponding to positioning bosses 401, and caulking hole 412 such that the fixing means on base plate 410 engages to the fixing means on base frame 12. Also, when base plate 410 is fixed to base frame 12, positioning bosses 401 and positioning holes 411 are engaged to each other for positioning, then caulking projection 402, inserted in caulking hole 412, is plastically deformed such that base plate 410 is fixed to base frame 12.

The relationship of engagement between the base plate fixing means on base frame 12 and the fixing means on base plate 410 can have a structure reversed from the above. In other words, the positioning holes and the caulking hole can be formed on base frame 12 while the bosses and the caulking projection can be formed on base plate 410. The base plate fixing means on base frame 12 can be formed at the same time as base frame 12 is plastically deformed such that low efficiency in manufacturing and high manufacturing cost can be avoided.

As described above, according to a music box of the present invention, a base frame is formed by plastic deformation of a metal plate, such as a steel plate, instead of by casting a frame, such as iron and zinc die casting; therefore, reducing the weight of the music box and increasing efficiency in manufacturing are accomplished. Consequently, the material and manufacturing costs are reduced.

If a thick metal plate is used for rigidity of the base frame, plastic deformation is difficult to apply thereon, and a large size metal processor is required. As a result, formation of a comb mount and bending/cutting-out of various bearings become difficult. However, in the present invention, sufficient rigidity strength is maintained by formation of a rigidity improving means (ribs or graining etc.) such that the rigidity is not decreased by thinning the metal plate, which is easier to process, used for the base frame.

Also, the entire edge of the comb mount is drawn such that it is continual with the flat portion of the base frame; therefore, vibration of the comb is effectively transmitted such that a loss of sound energy can be prevented. Furthermore, the base frame is formed as a continual plate such that the rigidity and efficiency in transmission of vibration are obtained when an intermittent part, such as a cutting-out, is eliminated from the edge of the comb mount on the base frame. As a result, high sound quality can be obtained in a similar manner as the above case frame.

Additionally, the comb base portion, especially the bottom of reeds of the comb base portion, tightly contacts the comb mount such that vibration of the comb is effectively transmitted to the base frame; in turn, the sound quality is improved.

Also, a pressurizing means provides a force to the drum in the thrust direction such that a space therein is eliminated; therefore, the positional relationship between the reeds and corresponding engaging pins is accurately maintained. As a result, a stable play of music is obtained, and a comb with high density of reeds is possible; thus, music played by the music box can be more freely produced.

Moreover, the bases on the bottom of the base frame are formed as three convexities, which are not positioned on one line, with a relatively small surface area. Therefore, the music box can be firmly mounted to prevent shaking, although the mount product does not have an even surface. Consequently, sound energy is effectively transmitted to the comb for amplification such that high sound quality is maintained.

While the present invention has been particularly shown and described in conjunction with preferred embodiments thereof, it will be readily appreciated by those of ordinary skill in the art that various changes may be made without departing from the spirit and scope of the invention.

Therefore, it is intended that the appended claims be interpreted as including the embodiments described herein, the alternatives mentioned above, and all equivalents thereto.

What is claimed is:

1. A music box comprising:

a base frame formed by a plastic deformation of a plate including a metal material;

a drum held on said base frame and which comprises a plurality of engaging pins;

a comb fixed to a comb mount formed on said base frame and which generates a given sound by being picked by said engaging pins; and a rigidity improving means for improving the rigidity of said base frame, wherein said rigidity improving means is a rib, wherein said rib has a cross section, which is arching, projecting over the top surface of said base frame and forms a continuously ridged rib pattern, and wherein said rib which is arching and said comb mount form a resonance space on the bottom surface of said base frame.

2. The music box of claim 1, wherein said rigidity improving means includes at least one of a rib formed on said base frame and a coining on the surface of said base frame.

3. The music box of claim 1, wherein said comb mount is formed by drawing and projects from a flat portion of said base frame such that its top end has a comb mount surface.

4. The music box of claim 3, wherein said comb mount has its side continuing to said flat portion and said comb mount surface all around.

5. The music box of claim 4, wherein said side of said comb mount is slanted upward from said flat portion to said comb mount surface.

6. The music box of claim 4, wherein a ridge bordering said comb mount surface and said side surface has an arc-shaped cross section.

7. The music box of claim 4, wherein said rigidity improving means is a rib wherein said comb mount and said rib are continually formed.

8. The music box of claim 1, wherein said plate is a steel plate with a thickness equal to or less than 3 mm.

9. The music box of claim 1, wherein said comb mount, which is made of a member different from said base frame, is fixedly held between said comb and said base frame.

10. The music box of claim 1, wherein said comb mount is molded out of a synthetic resin on said base frame.

11. The music box of claim 1, wherein a phony of relatively small flat surfaces, which project from the back surface of said base frame and which are apart from each other, are bases onto which said music box is mounted.

12. The music box of claim 11, wherein said bases are formed apart from each other at three vertexes of a triangle.

13. The music box of claim 3, wherein said comb mount surface is formed such that it tightly contacts the base portion of said comb.

14. The music box of claim 3, wherein said comb mount surface is shaped wider than but almost identical to said base portion of said comb.

15. The music box of claim 3, further comprising a vibration transmitting portion which transmits vibration by contacting a part around the base of said reeds in said base portion of said comb to said comb mount surface.

16. The music box of claim 1, wherein said rib pattern includes one branch of rib, which extends parallel to the rotational shaft of said drum, and two parallel branches of ribs, which extend from the both ends of said one branch of rib and which are continual with said comb mount; and said rib pattern squarely separates a space between the bottom part of said drum and said comb mount.

17. The music box of claim 1, wherein an attachment base plate fixing means, which is across from said comb mount sandwiching said drum, is formed by plastic deformation at the end of said base frame.

18. The music box of claim 1, further comprising:

a spring as a drive;

an acceleration gear train which transmits the released force of said spring as a rotational force; and a speed adjusting mechanism which is formed at the last gear of said acceleration gear train and which rotates said drum at an almost constant speed by controlling said rotational speed;

wherein a bearing portion, which supports said acceleration gear train, is formed by plastic deformation of said base frame.

19. The music box of claim 1, further comprising:

a spring as a drive;

a speed adjusting mechanism which rotates said drum at an almost constant speed by controlling the speed of said released force of said spring; and a housing which holds said spring and said speed adjusting mechanism;

wherein said nb pattern includes one branch of rib, which extends parallel to the rotational shaft of said drum, and two parallel branches of ribs, which extend from the both ends of said one branch of nb and which are continual with said comb mount; and said rib pattern also comprising:

a first rib group which squarely separates a space between the bottom part of said drum and said comb mount; and a second nb group which includes a rib, which extends from said one branch of rib to said housing, and a nb, which is almost perpendicular to said two branches of ribs and which extends from said comb mount to the vicinity of said speed adjusting mechanism.

20. The music box of claim 1, further comprising:

a spring as a drive;

a speed adjusting mechanism which rotates said drum at an almost constant speed by controlling the speed of said released force of said spring; and a housing which holds said spring and said speed adjusting mechanism;

and wherein, a bearing, which supports one end of the rotational shaft of said drum, is formed on said housing; and a bearing frame, which supports another end of the rotational shaft of said drum, is formed by plastic deformation of a plate formed together with said base frame.

21. The Music box of claim 20, further comprising an output shaft which engages to a gear formed at the outer circumference of one end of said drum to provide the rotation of said gear to the outside; wherein a bearing portion, which supports one end of said output shaft, is formed on said housing; and another bearing portion, which supports the other end of said output shaft, is formed on said bearing frame.

22. The music box of claim 20, wherein a pressuring means, which pressurizes said drum in the thrust direction towards said housing, is formed between said drum and said bearing frame or on said bearing frame.

23. The music box of claim 1, wherein the rigidity improving means is located under the drum.

* * * * *